United States Patent [19]

Honegger

[11] 4,438,618

[45] Mar. 27, 1984

[54] APPARATUS FOR STACKING PRINTED PRODUCTS, SUCH AS NEWSPAPERS, PERIODICALS AND THE LIKE, ARRIVING IN AN IMBRICATED PRODUCT STREAM

[75] Inventor: Werner Honegger, Tann-Rüti, Switzerland

[73] Assignee: Ferag AG, Hinwil, Switzerland

[21] Appl. No.: 280,998

[22] Filed: Jul. 6, 1981

[30] Foreign Application Priority Data

Jul. 15, 1980 [CH] Switzerland ..... 5400/80

[51] Int. Cl.[3] ..... B65B 63/04

[52] U.S. Cl. ..... 53/430; 53/118; 242/59; 242/67.3 R; 414/29; 414/112

[58] Field of Search ..... 53/118, 430; 242/59, 242/67.3 R, 75.4; 271/3, 8; 414/29, 112, 129, 130

[56] References Cited

U.S. PATENT DOCUMENTS

| | | | |
|---|---|---|---|
| 1,126,006 | 1/1915 | Harwood | 242/59 |
| 1,838,065 | 12/1931 | Last . | |
| 3,862,802 | 1/1975 | Till | 271/3 X |
| 4,000,864 | 1/1977 | Kurtz et al. | 242/59 |
| 4,063,693 | 12/1977 | Acheltohl et al. | 53/118 X |
| 4,291,460 | 9/1981 | Stoehr | 53/118 X |

FOREIGN PATENT DOCUMENTS

| | | | |
|---|---|---|---|
| 153740 | 7/1952 | Australia | 53/118 |
| 1244656 | 7/1967 | Fed. Rep. of Germany . | |
| 2207556 | 8/1973 | Fed. Rep. of Germany . | |
| 2804178 | 8/1979 | Fed. Rep. of Germany . | |
| 559691 | 1/1975 | Switzerland . | |
| 488675 | 7/1938 | United Kingdom | 53/118 |

*Primary Examiner*—James F. Coan
*Attorney, Agent, or Firm*—Werner W. Kleeman

[57] ABSTRACT

By means of winder gearing maintaining essentially constant the winding speed a drive motor drives a winding mandril. Operatively associated with the winding mandril is a winding band which is paid-off of a freely rotatable supply roll. Engaging at this supply roll is a jaw brake. The winding or wind-up band is guided over a balance or rocker arm which is upwardly and downwardly pivotable about a pivot axis. By means of a contact or pressing mechanism the balance arm is pressed against the winding mandril. The imbricated printed product stream, infed from a band conveyor, arrives at the balance arm or rocker and the winder band and is supported thereat. The thus supported imbricated printed products are infed from below to a winder gap and in conjunction with the winder band wound-up on the winder mandril. The winder band separates the individual wound layers or plies from one another. By braking the supply the winding of the winder band is accomplished with tension, so that there is formed a snug or tightly wound package in which the printed products are unable to alter their position within the imbricated product formation or stream. Due to the bottom or underfeed of the winder band and the printed products reposing thereon there is required only a single winder or winding band. To ensure for an adhesion between the surface of the winder band confronting the imbricated product formation and the printed products the winder band preferably is formed of an adhesive material. As a further possibility this winder band surface can be rendered adhesive in a suitable manner or provided with an adhesive coating.

30 Claims, 3 Drawing Figures

APPARATUS FOR STACKING PRINTED PRODUCTS, SUCH AS NEWSPAPERS, PERIODICALS AND THE LIKE, ARRIVING IN AN IMBRICATED PRODUCT STREAM

BACKGROUND OF THE INVENTION

The present invention relates to a new and improved construction of apparatus for stacking printed products arriving in an imbricated product formation or stream, such as newspapers, periodicals and the like. The invention further concerns apparatus for destacking a stack which has been formed with the aid of the aforementioned stacking apparatus or stacker.

Generally speaking, the stacking apparatus of the present development is of the type comprising a rotatably driven winding mandril for winding-up the imbricated product formation and a separation layer operatively associated or connected with the winding mandril.

In German Patent No. 1,244,656, published July 13, 1967, there is disclosed an apparatus for storing veneer sheets, wherein the veneer sheets reposing upon a pressure band are fed from below to a drum. The revolvingly driven pressure band extends almost along the entire circumference of the drum, and therefore, serves both for the infeed and also for the support of the loose veneer sheets before and during the winding operation. The individual wound layers or package plies are separated from one another by a separation or partition band connected with the drum. This separation band is placed over the veneer sheets at the region of a winding gap and is wound-up along with the veneer sheets. Since the outermost ply or layer of the thus formed package must be supported by the pressure band, the package cannot be readily removed from the stacking apparatus. As a rule, the package remains in the stacker apparatus until such time as it is destacked, this stacker apparatus being convertible into the destacking apparatus by carrying out appropriate equipment conversion manipulations, so that the destacking apparatus cannot be employed during the storage time of the stack for the formation of a new stack.

Also, in German Patent No. 2,207,556 published August 30, 1973, there is disclosed a stacker apparatus of the previously mentioned type, wherein the printed products arriving in an imbricated product formation are brought together by means of winder or winding bands both at the top surface and also at the bottom surface thereof. The imbricated product formation is retained between the winding bands. These winding bands together with the intermediately reposing printed products are infed from above, i.e. overhead, to the winder drum and wound thereon. After the winder drum has been filled, then the ends of both winding bands are firmly lashed together in order to retain the finished package. The need to provide two winding bands is associated with a corresponding complication in the equipment design and the expenditure in materials. Additionally, notwithstanding the presence of two winding bands, in many instances it is necessary to provide side or cheek plates at the winder drum, in order to prevent any disintegration of the stack or a positional change of the printed products within the imbricated product formation during manipulation of the finished stack.

SUMMARY OF THE INVENTION

Therefore, with the foregoing in mind it is a primary object of the present invention to provide a new and improved construction of apparatus for stacking products, particularly printed products, such as newspapers, periodicals and the like, arriving in an imbricated product formation, in a manner not associated with the aforementioned drawbacks and limitations of the prior art constructions.

Another and more specific object of the present invention aims at providing a new and improved construction of apparatus of the character described which, with extremely modest equipment and material expenditure, enables the positive formation of a wound stack, at which the products maintain their position within the imbricated product formation even when handling the wound stack, for instance during transporting thereof.

Yet a further significant object of the present invention aims at providing a new and improved construction of destacking apparatus for destacking printed products which have been stacked by means of the stacking apparatus of the invention.

A further significant object of the present invention aims at providing novel material handling apparatus, namely a stacker and a destacker, respectively, which in each case are of relatively simple construction and design, extremely reliable in operation, quite economical to manufacture, not readily subject to breakdown or malfunction, and require a minimum of maintenance and servicing.

Now in order to implement these and still further objects of the invention, which will become more readily apparent as the description proceeds, the stacker apparatus for stacking products arriving in an imbricated product formation or product stream, such as typically newspapers, periodicals and the like, as contemplated by the present development is manifested by the features that the separation or partition layer is formed by a single, bottom-fed and tensioned winding band which travels onto the winding mandril. This bottom-fed winding band travels onto the underside of the imbricated product formation which likewise is infed from below, i.e. bottom-fed.

The infeed of the imbricated product stream to the winding or winder mandril from below, also referred to herein as "bottom or underfeed", enables using only a single winding band. Since this winding band is wound-up under tension there is obtained a taut or tightly wound package in which the printed products maintain their mutual position, without the need to provide at the winding mandril side or cheek plates or other such type additional aids.

Preferably, the winding band is provided at the side confronting the imbricated product formation with an adhesion or adhesive property in relation to the printed products. This contributes to a further positional fixation of the printed products which are being handled.

If there prevails an adhesion between the surfaces of the winding band, then it is possible to obtain a retention of the finished stack in a most simple manner in that, at the end of the winding operation or product stacking process, the empty winding band is wound under tension one or a number of times over the previously wound winding band layer or ply.

As already indicated heretofore, the invention also contemplates the provision of an apparatus for destacking a printed product stack formed with the previously discussed stacking apparatus. According to the invention this destacking apparatus withdraws the single winding band forming the separation layer together with the printed products reposing on the winding band in an imbricated product formation, from below off of the rotatably mounted package.

Due to the withdrawal of the winding band from below the printed products are likewise conjointly unwound and after separation from the winding band can be outfed in an imbricated product formation. Since each printed product bears upon the next following printed products there is ensured for a faultless detachment of the printed products from the product package or wound structure.

It is advantageous to provide a regulation device for maintaining constant the tension force applied to the winding band, in order to thus favour a faultless destacking operation.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
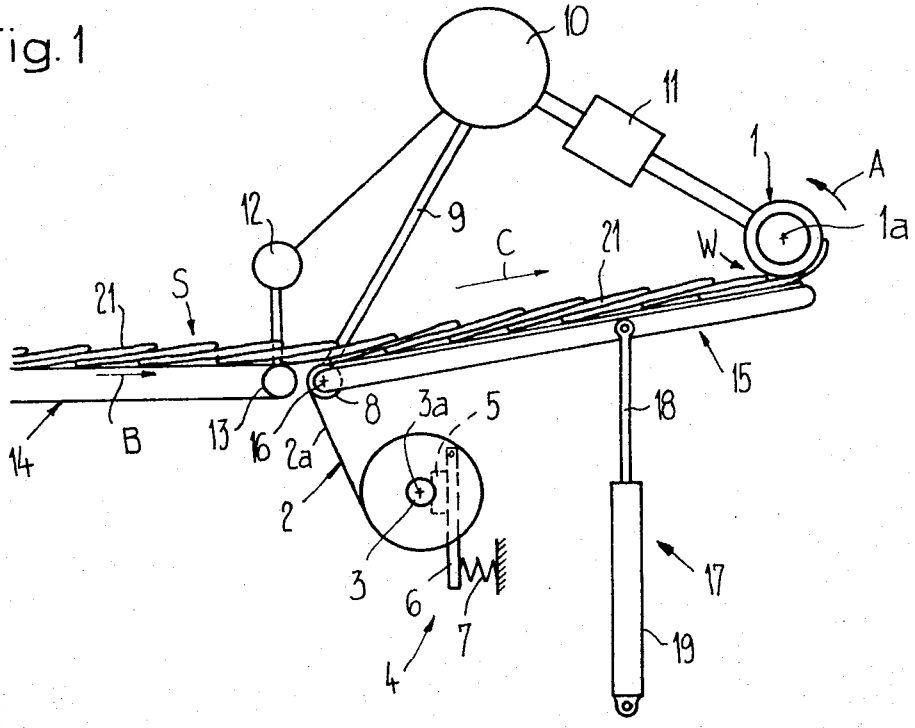
FIGS. 1 and 2 illustrate an exemplary embodiment of stacking apparatus for forming a printed product stack in the form of a wound package and respectively illustrating such stacking apparatus during different working phases or steps.
Figure 2:
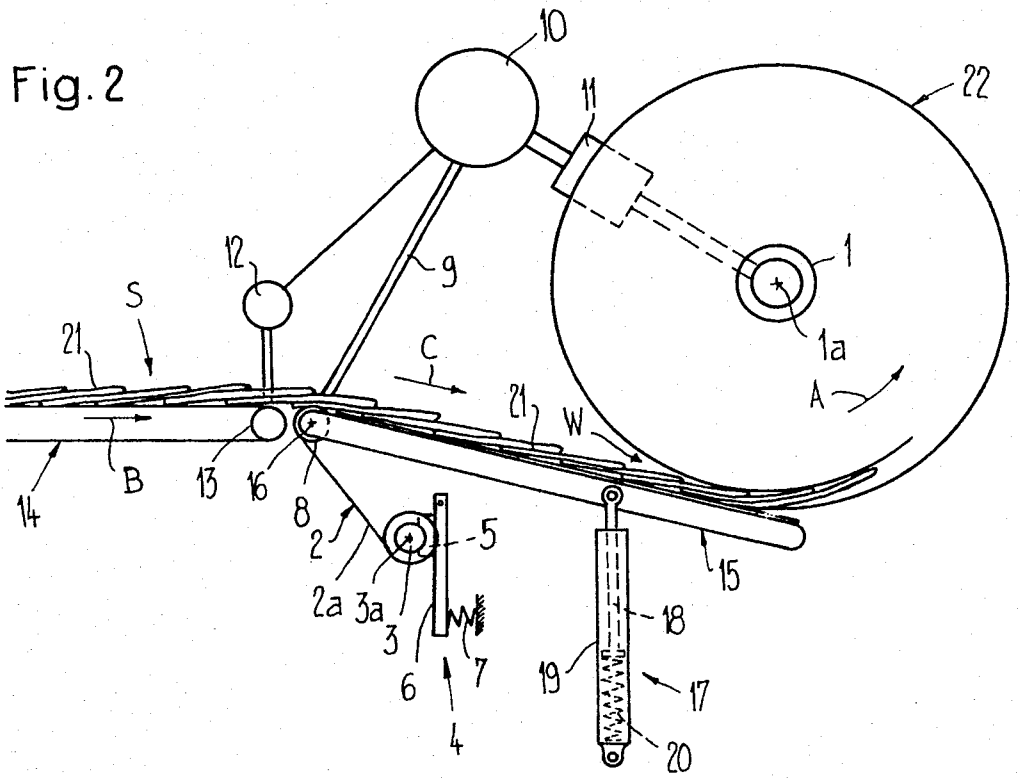

Describing now the drawings, in FIGS. 1 and 2 there has been shown an exemplary embodiment of stacking apparatus for stacking products, such as printed products, typically newspapers, periodicals or the like. To simplify the illustration only enough of the construction of the stacking apparatus has been shown in order to enable those skilled in the art to readily understand the underlying principles and concepts of the present development.

Turning now specifically to FIG. 1 there is shown therein the stacking apparatus at the start of the winding operation, whereas in FIG. 2 the stacking apparatus has been illustrated at a later point in time during which the package of stacked products is being formed. A substantially drum-shaped winding or winder mandril 1 is rotatably mounted in any suitable fashion so that it can rotate about its lengthwise axis 1*a*. At the winding mandril 1 there is attached the one end of a winding or winder band 2 or equivalent winding structure. The winding band 2 is paid-off a wind-off roll 3. This wind-off roll 3 is freely rotatably mounted for rotational movement about its axis of rotation 3*a*. Engaging at this wind-off roll 3 is a jaw brake or equivalent brake means, generally indicated by reference character 4. This jaw brake 4 contains a brake jaw 5 which bears at the wind-off roll 3. Brake jaw 5 is secured at a lever 6 which is rotatably mounted at one end. Engaging at the lever 6 is a compression or pressure spring 7 causing contact of the brake jaw 5 with the wind-off roll 3.

The winding or winder band 2 is guided from the wind-off roll 3 over a conveyor roll 8 which is operatively associated by means of a suitable drive connection, generally indicated by reference character 9, with a drive motor 10. This drive motor 10 drives, by means of a winder gearing 11, the winding or winder mandril 1 in the direction of the arrow A. The winder gearing 11 regulates the drive velocity of the winding mandril 1 in such a manner that the wind-up speed remains essentially constant independent of the diameter of the wound package. The winder or winding gearing 11 is of conventional design and commercially available, for instance, from the West German firm known as Firma P.I.V. Antrieb Werner Reimers KG. Operatively associated with the drive motor 10 is a tachogenerator 12 which is driven by a deflection roll 13 of a belt or band conveyor 14. This belt or band conveyor 14 or equivalent conveying device is revolvingly driven in any suitable manner, as is well known in this art, in the direction of the arrow B. By means of the control connection between the belt conveyor 14 and the drive motor 10 it is possible to accommodate the rotational speed of the winding mandril 1 to the infeed speed of the belt conveyor 14.

Between the belt conveyor 14 and the winding mandril 1 there is arranged a rocker or balance arm 15 or equivalent structure serving as a slide or chute. This rocker or balance arm 15 is mounted to be pivotable about a pivot axis 16 which extends essentially parallel to the axis of rotation 1*a* of the winding mandril 1 and coincides with the axis of rotation of the conveyor roll 8. At the balance arm or rocker 15 there engages a contact or pressure mechanism, generally designated by reference character 17. This contact or pressure mechanism 17 contains a pressure rod 18 which is hingedly connected with the rocker or balance arm 15. This pressure rod 18 or equivalent structure is mounted in a stationary housing 19 in which there is accommodated a compression spring 20 acting upon the pressure rod 18, as best seen by referring to FIG. 2. By virtue of this contact or press mechanism 17 the rocker or balance arm 15 is upwardly pressed towards the winding mandril 1 and against the package which is forming thereon.

The belt or band conveyor 14 infeeds the printed products 21 which repose upon one another in the manner of tiles of a roof and thus form an imbricated product stream or formation S. As best seen by referring to FIGS. 1 and 2, each printed product 21 bears, within the imbricated product formation. S, in an imbricated-like manner upon the preceeding or downstream located printed product. The imbricated printed product formation S can be infed, for instance, by the belt conveyor 14 from the output of a rotary printing press. As also will be seen by referring to FIGS. 1 and 2, the winding band 2 travels from the wind-off roll 3 over the conveyor roll 8 and while bearing upon the balance arm or rocker 15 is fed to the winding mandril 1. The imbricated product formation S is moved by the belt or band conveyor 14 onto the balance arm or rocker 15 and upon the winding band 2 reposing thereon. The side 2*a* of the winding band 2, which confronts the imbricated product formation or stream S, is structured such that an adhesion exists between the winding band 2 and the printed products 21. For this purpose the winding band 2 can be formed of an adhesive material, for instance a suitable plastics material. However, it is also possible to render the surface 2*a* of the winding band 2 adhesive or to apply an adhesive layer to such surface or side 2*a*.

By means of the driven winding mandril 1 the winding band 2 together with the printed products 21 reposing thereon, are moved in the direction of the arrow C along the rocker 15 and wound-up upon the mandril 1. The co-wound winding band 2 functions as a separation or partition layer between the package layers or plies. The winding roll 3 is braked by the jaw brake 4 during the winding operation, so that the winding band 2 is wound-up while in a tensioned state upon the winding mandril 1. It should be readily understood and as mentioned heretofore that instead of using the jaw brake 4 also other devices can be employed for generating a tension in the winding band 2 during the winding operation. Thus, for instance, there could be utilised a suitable band tensioning device of known design.

During the winding operation the rocker or balance arm 15 is downwardly rocked about its pivot axis 16 by the weight of the formed package 22 and against the force of the compression spring 20. This has been clearly shown by a comparison of FIGS. 1 and 2. Under the action of this compression or pressure spring 20 the rocker or balance arm 15 is pressed against the package 22, so that there is caused a compression or pressing of the printed products 21 which are infed to the winding gap W.

It also would be conceivable to design the balance arrangement, i.e. the balance arm or rocker 15 so as to be stationary and to construct the winding mandril 1 so as to be elevationally displaceable in order to compensate for the package diameter and to generate a compressive force or pressing action. The balance arrangement 15, under circumstances, also could be dispensed with, and in that instance the winding band 2 receives the imbricated product formation S from the belt conveyor 14 and infeeds such to the winding gap W. With this design the winding band 2, apart from having a conveying function, also assumes a support function. Therefore, in light of the previous comments it is to be understood that the term "balance" or "rocker" as used herein is employed in a broader sense to denote not only movable but also fixed balance or rocker structures.

By virtue of the fact that the winding band 2 and the printed products 21 which are reposing thereon are infed from below to the winding mandril 1, there is needed only a single winding band 2. By virtue of the winding-up of the winding band 2 under tension there is obtained a compact and densely wound package 22 in which the printed products 21 are faultlessly maintained in their position within the imbricated product formation S without the need to resort to additional aids or expedients, and specifically also when handling the wound product package 22, such as during transport and the like. The already described pressing of the printed products 21 at the region of the winding gap W further contributes to increasing the strength of the finished wound package 22.

At the completion of the winding operation the empty winding band 2 is wrapped once or a number of times about the finished wound package 22, so that each new winding band layer or ply bears upon the previously wound winding band layer or ply. The adhesion prevailing between the winding band plies is sufficient for retaining together the wound package 22. No additional measures are needed for attachment of the free end of the winding band 2.

The finished wound package 22 now can be removed from the described stacking apparatus and intermediately stacked. If the stacked printed products 21 are again needed for further processing, then for destacking the wound stack the package 22 is delivered to the destacking apparatus or destacker shown in FIG. 3.

This destacker apparatus corresponds in its design to the stacking apparatus shown and described above with reference to FIGS. 1 and 2. It will be seen to comprise a wind-up roll 23 for the winding band 2 and which is mounted to be rotatable about its lengthwise axis 23*a*. This wind-up or winding roll 23 is operatively drivingly associated by means of a winding gearing 24 with a suitable drive motor 25. The winding gearing 24, corresponding to the winding gearing 11 of the stacking apparatus of FIGS. 1 and 2, ensures that the wind-up speed of the winding band 2 remains essentially constant independent of the varying diameter of the package 22. By means of the merely schematically illustrated drive connection, generally indicated by reference character 26, the drive motor 25 drives a conveyor roll or roller 27 over which travels the winding band 2. By means of a suitable drive element 28, for instance a chain or a belt, the drive motor 25 also drives a deflection roll 29 of a band or belt conveyor 30. This band or belt conveyor 30 or equivalent conveying structure serves to move and outfeed the unwound imbricated product stream or formation S' in the direction of the arrow F.

Between the outfeed conveyor 30 and the package 22 there is likewise arranged a rocker or balance arm 31 which, as to its design, can correspond to that of the balance arm or rocker 15 discussed in conjunction with the equipment of FIGS. 1 and 2. The rocker 31 is pivotably mounted for movement upwardly and downwardly about its pivot axis 32 which coincides with the lengthwise axis of the conveyor roll 27. Likewise engaging at the rocker or balance arm 31 is a contact or press mechanism 33. Here also the contact or press mechanism 33 will be seen to comprise, by way of example, a pressure or press rod 35 guided within a housing 34 and bearing against a suitable conpression or pressure spring, which is here not shown to simplify the illustration, but may be like the compression spring 20 of the arrangement of FIG. 2. The contact mechanism 33, which is designed like the contact or press mechanism 17 of the arrangement of FIGS. 1 and 2, serves to press the rocker 31 against the wound package 22.

A jaw brake 36, which may be designed like the jaw brake 4 of the arrangement of FIGS. 1 and 2, engages at the winding mandril 1 which is mounted to be freely rotatable about its rotational axis 1*a*. A brake jaw 37 which is pressed against the winding mandril 1 is secured to a rotatably mounted lever 38 at which engages a compression or pressure spring 39. This compression spring 39 or equivalent structure biases the brake jaw 37 against the winding mandril 1. Owing to the braking force exerted by the jaw brake 36 upon the winding mandril 1, the winding band 2 is under a tensional force during the unwinding operation. The tension exerted at the winding band 2 should remain constant in order to ensure for a faultless detachment of the individual wound product layers during the unwinding operation. It should be understood that instead of using the jaw brake 36 it would be possible to employ other suitable band tension regulation devices of known construction, in order to apply the aforementioned essentially constant tension.

The winding-up of the winding band 2 upon the wind-up or winding roll 23 results in a rotation of the package 22 in the direction of the arrow D and unwinding of the printed products 21. The imbricated product formation S' which is removed from the package 22 is moved by the winding band 22 along the balance arm or rocker 31 in the direction of the arrow E and finally transferred to the belt or band conveyor 30 for the outfeed of the thus handled products. The mutual position of the printed products 21 within the outfed imbricated product stream S' is thus essentially the same as that within the imbricated product stream S infed to the winding or stacking apparatus of FIGS. 1 and 2.

Figure 3:
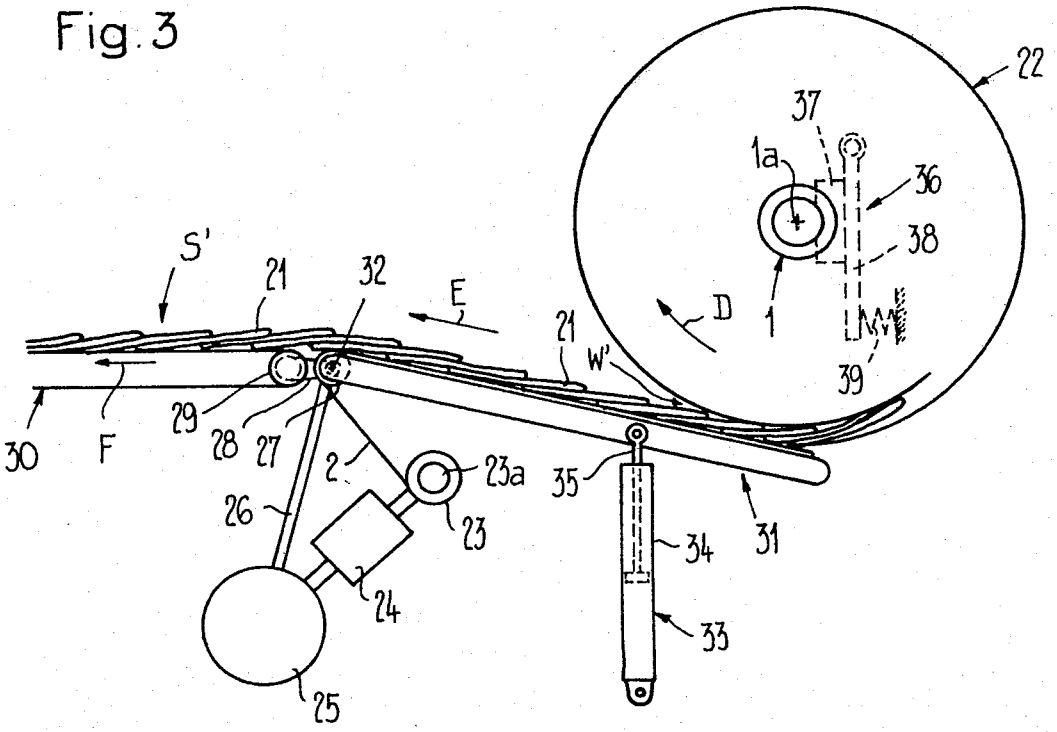
FIG. 3 illustrates an exemplary embodiment of destacking apparatus for destacking the stack formed with the stacker or stacking apparatus illustrated in FIGS. 1 and 2.

Since, as is shown in FIG. 3, in the unwound imbricated product stream S' each printed product 21 bears in each case upon the next following printed product, it is possible to detach without any problem the printed products from the package 22 at the region of the unwinding or wind-off gap W'. By the action of the weight of the preceding printed product the printed products are pressed away from the wound package 22 towards the rocker or balance arm 31, so that any possibly prevailing adhesion force between the printed product and the outermost package layer or ply can be overcome without the need to resort to any additional aids for this purpose.

Just as was the case with respect to the stacking apparatus described above in conjunction with the illustration of FIGS. 1 and 2, here also it is possible, under circumstances, to dispense with the use of the rocker 31. The winding band 2, in this case, serves as a support for the detached printed products 21.

After having accomplished the complete destacking or unwinding of the package 22 the winding band 22, wound up upon the wind-up roll 23, can be reused for forming a new package.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An apparatus for stacking printed products, especially newspapers, periodicals and the like, arriving in an imbricated product formation, each of said printed products having a trailing edge and a leading edge, comprising:

a rotatably driven winding mandril rotatable about an axis of rotation for winding-up the imbricated product formation into a wound imbricated package formation;

a separation layer connected with the rotatably driven winding mandril and which, during winding of the imbricated product formation, is wound-up under tension in the form of individual tensioned coils between package layers of the wound imbricated package formation;

said separation layer comprising a winding band which is infed to the rotatably driven winding mandril and is under tension;

means including the rotatably driven winding mandril for infeeding the separation layer under tension to the rotatably driven winding mandril and into the wound imbricated package formation;

drive means for driving the winding mandril such that said individual coils of the separation layer which are wound onto the winding mandril are wound thereon under tension;

means for infeeding the imbricated product formation at a predetermined infeed velocity to the rotatably driven winding mandril with the trailing edges of the products of the imbricated product formation bearing upon the separation layer;

means cooperating with said infeeding means for the imbricated product formation and said drive means for accommodating a winding-up velocity of the winding mandril as a function of the predetermined infeed velocity of the imbricated product formation;

means for regulating driving of the rotatably driven winding mandril as a function of the diameter of the wound imbricated package formation; and said rotatably driven winding mandril being positioned relative to said separation layer such that the leading edges of the printed products are situated closer to the axis of rotation of said rotatably driven winding mandril than the trailing edges of the printed products which bear upon said separation layer.

2. The apparatus as defined in claim 1, wherein:

said winding band possesses a band side confronting the imbricated product formation and exhibiting adhesion properties with respect to the products.

3. The apparatus as defined in claim 2, wherein:

said winding band possesses an adhesion property between surfaces thereof.

4. The apparatus as defined in claim 3, wherein:

the side of the winding band confronting the imbricated product formation is structured as a static friction surface.

5. The apparatus as defined in claim 3, wherein:

the side of the winding band confronting the imbricated product formation is provided with an adhesive agent.

6. The apparatus as defined in claim 5, wherein: said adhesive agent comprises a glue.

7. The apparatus as defined in claim 3, wherein:

said winding band is composed of an adhesive material.

8. The apparatus as defined in claim 1, wherein:

said winding band possesses an adhesion property between surfaces thereof.

9. The apparatus as defined in claim 8, wherein:

the side of the winding band confronting the imbricated product formation is structured as a static friction surface.

10. The apparatus as defined in claim 9, wherein:

the side of the winding band confronting the imbricated product formation is provided with an adhesive agent.

11. The apparatus as defined in claim 10, wherein:

said adhesive agent comprises a glue.

12. The apparatus as defined in claim 2, wherein:

said winding band is composed of an adhesive material.

13. The apparatus as defined in claim 2, wherein:

said winding band comprises a plastic foil.

14. The apparatus as defined in claim 1, wherein:

said means for regulating driving of the rotatably driven winding mandril comprises winder gearing means.

15. The apparatus as defined in claim 1, wherein:

said means for infeeding the separation layer under tension comprises a brake device for braking forward movement of the winding band.

16. The apparatus as defined in claim 15, further including:

a freely rotatably mounted supply roll for supplying the winding band; and said brake device engaging at said supply roll.

17. The apparatus as defined in claim 1, wherein:

said means cooperating with said infeeding means for the imbricated product formation and said drive means comprises tachogenerator means.

18. A method for stacking printed products, especially newspapers, periodicals and the like, arriving in an imbricated product formation, each of said printed products having a leading edge and a trailing edge, comprising the steps of:

providing a separation layer at which bears the imbricated product formation such that each of the trailing edges of said imbricated product formation contacts said separation layer;

providing a rotatably driven winding mandril rotatable about an axis of rotation for winding-up the imbricated product formation into a wound imbricated package formation, with said rotatably driven winding mandril being positioned relative to said separation layer such that the axis of rotation thereof is situated closer to said leading edges of the printed products than the trailing edges bearing at said separation layer;

connecting an end portion of said separation layer with said rotatably driven winding mandril;

providing a drive for the rotatably driven winding mandril which is operative such that individual coils of the separation layer which are wound onto the winding mandril are wound thereon under tension; and placing into operation said drive and thus winding-up said separation layer connected with the rotatably driven winding mandril while maintaining said separation layer under tension during said winding operation, in order to wind the imbricated product formation into a wound imbricated package formation, with the separation layer being wound-up in tensioned individual coils between package layers of the wound imbricated package formation.

19. The method as defined in claim 18, further including the steps of:

positioning the separation layer relative to the rotatably driven winding mandril such that the imbricated product formation is located inwardly of said separation layer.

20. The method as defined in claim 18, further including the steps of:

winding-up said separation layer upon said rotatably driven winding mandril such that the trailing edges of printed products of a last fully wound package layer of the wound imbricated package formation are situated adjacent leading edges of printed products of an outermost package layer which is in the process of being wound upon the rotatably driven winding mandril.

21. The method as defined in claim 18, wherein:

said drive cooperates with said rotatably driven winding mandril such that said winding mandril is centrally driven in order to tension and maintain in a tensioned state the individual coils of the separation layer which are wound onto the rotatably driven winding mandril.

22. An apparatus for destacking a stack of printed products, especially newspapers, periodicals and the like, wound in an imbricated package formation upon a rotatably driven winding mandril, with a tensioned separation layer wound between the layers of the wound package, comprising:

unwinding means for the tensioned separation layer constituted by a single winding band;

said unwinding means withdrawing from the wound package which is rotatably mounted and from the underside thereof the single winding band together with the printed products reposing in an imbricated product formation upon such winding band; and regulation means for maintaining essentially constant a tension force engaging at the winding band.

23. The apparatus as defined in claim 22, wherein:

said unwinding means comprises a driven wind-up roll for the winding band and brake means engaging at the freely rotatably mounted wound package.

24. An apparatus for stacking printed products, especially newspapers, periodicals and the like, arriving in an imbricated product formation, each of said printed products having a trailing edge and a leading edge, comprising:

a rotatably driven winding mandril rotatable about an axis of rotation for winding-up the imbricated product formation into a wound imbricated package formation;

a separation layer connected with the winding mandril and which, during winding of the imbricated product formation, is wound-up under tension in the form of individual tensioned coils between package layers of the wound imbricated package formation;

said separation layer comprising a winding band which is infed to the rotatably driven winding mandril and is under tension;

means including the rotatably driven winding mandril for infeeding the separation layer under tension and maintaining the tension in the individual coils of the separation layer which are wound onto the wound imbricated package formation;

drive means for driving the winding mandril such that said individual coils of the separation layer which are wound onto the winding mandril are wound thereon under tension;

said separation layer contacting the imbricated product formation such that the trailing edges of the products contact said separation layer; and said rotatably driven winding mandril being positioned relative to said separation layer such that the leading edges of the printed products are located closer to the axis of rotation of said rotatably driven winding mandril than the trailing edges of the printed products which bear at said separation layer.

25. The apparatus as defined in claim 24, wherein:

said separation layer is arranged relative to said rotatably driven winding mandril such that the printed products bearing thereat are situated inwardly thereof and are positioned intermediate said axis of rotation of said rotatably driven winding mandril and an incoming portion of said separation layer which is infed substantially tangentially to said rotatably driven winding mandril.

26. An apparatus for stacking printed products, especially newspapers, periodicals and the like, arriving in an imbricated product formation, each of said printed products having a trailing edge and a leading edge, comprising:

a rotatably driven winding mandril rotatable about an axis of rotation for winding-up the imbricated product formation into a wound imbricated package formation;

a separation layer connected with the rotatably driven winding mandril and which, during winding of the imbricated product formation, is wound-up under tension in the form of individual tensioned coils between package layers of the wound imbricated package formation;

said separation layer comprising a winding band which is infed from below to the rotatably driven winding mandril and is under tension;

means including the rotatably driven winding mandril for infeeding the separation layer under tension and maintaining the tension in the individual coils of the separation layer which are wound onto the wound imbricated package formation;

drive means for driving the winding mandril such that said individual coils of the separation layer which are wound onto the winding mandril are wound thereon under tension;

means for infeeding from below the imbricated product formation to the rotatably driven winding mandril with the trailing edges of the printed products of the imbricated product formation bearing upon the separation layer;

said rotatably driven winding mandril being positioned relative to said separation layer such that the leading edges of the printed products are situated closer to the axis of rotation of said rotatably driven winding mandril than the trailing edges of the printed products which bear upon said separation layer; and said winding band extending along the underside of the imbricated product formation which is infed from below.

27. The apparatus as defined in claim 1, further including:

means defining a support element arranged forwardly of said winding mandril;

said winding band and the imbricated product formation reposing upon said winding band travelling over said support element; and means for accommodating the diameter of the package of printed products wound upon the winding mandril relative to the winding mandril such that the support element is maintained with a predetermined force in contact with the wound package.

28. The apparatus as defined in claim 27, wherein:

said accommodating means serves to maintain the support element at a substantially constant force in contact with the wound package.

29. The apparatus as defined in claim 27, wherein:

said support element comprises a substantially rocker-like structure;

means defining a pivot axis for the support element;

said pivot axis extending essentially parallel to the lengthwise axis of the winding mandril; and contact means for pressing the support element against the wound package.

30. The apparatus as defined in claim 29, wherein:

said contact means includes spring force applying means.

* * * * *